US005160941A

United States Patent [19]

Fujiwara et al.

[11] Patent Number: 5,160,941

[45] Date of Patent: Nov. 3, 1992

[54] METHOD FOR DRIVING THERMAL PRINT HEAD TO MAINTAIN MORE CONSTANT PRINT DENSITY

[75] Inventors: Yoshihisa Fujiwara, Kadoma; Hirokazu Genno, Hirakata, both of Japan

[73] Assignee: Sanyo Electric Co., Ltd., Osaka, Japan

[21] Appl. No.: 690,095

[22] Filed: Apr. 23, 1991

[30] Foreign Application Priority Data

Apr. 26, 1990 [JP] Japan ..... 2-111938

[51] Int. Cl.[5] ..... B41J 2/32

[52] U.S. Cl. ..... 346/76 PH

[58] Field of Search ..... 346/76 PH

[56] References Cited

U.S. PATENT DOCUMENTS 4,774,528 9/1988 Kato ..... 346/76 PH 4,804,976 2/1989 Ohmori et al. ..... 346/76 PH

OTHER PUBLICATIONS

Sublimation Dye Transfer Process (pp. 70–71) Japanese document already submitted.

*Primary Examiner*—Mark J. Reinhart

*Attorney, Agent, or Firm*—Darby & Darby

[57] ABSTRACT

A method of driving a thermal head enabling recording of multiple gradations and having a plurality of heating resistors, comprising: a first step of calculating an amount of density correction, corresponding to an amount of decrease of printed density of the specific ones of the heating resistors due to reduction of quantity of heat generated by the specific ones of the heating resistors, which reduction is caused by simultaneous heating of the specific ones of the heating resistors and the remaining heating resistors; and a second step of applying to the specific ones of the heating resistors, a print signal corrected on the basis of the amount of density correction so as to drive the specific ones of the heating resistors such that a desired printed density is obtained; in which in the first step, the amount of density correction is calculated on the basis of a weight factor, an imaginary number of the heating resistors and a maximum amount of density decrease.

3 Claims, 8 Drawing Sheets

METHOD FOR DRIVING THERMAL PRINT HEAD TO MAINTAIN MORE CONSTANT PRINT DENSITY

BACKGROUND OF THE INVENTION

The present invention relates to a method of controlling heating resistors in a sublimation thermal transfer recording apparatus for performing recording having density of multiple gradations by using a thermal head.

In a known sublimation thermal transfer recording apparatus, a plurality of heating resistors are arranged in a line on a thermal head and are energized to be heated such that printing is performed on a recording medium. FIG. 1 shows an electric circuit of the known thermal head. The known thermal head includes heating resistors $R_i$ (i=0–1279 typically), a common resistor $r_1$ and an FPC electrode resistor $r_2$. From FIG. 1, a voltage V applied to the heating resistors $R_i$ is given by the following equation (a):

$$V = V_H \times R/(R + n \cdot r) \quad \text{(a)}$$

where $V_H$ denotes a voltage applied to the thermal head, R denotes a resistance value of each heating resistor, n denotes the number of the heating resistors $R_i$ driven simultaneously and r denotes a sum of a resistance value of the common resistor $r_1$ and a resistance value of the FPC electrode resistor $r_2$. It will be seen from the equation (a) that the voltage V is a function of the number n, the resistance value of the common resistor $r_1$ and the resistance value of the FPC electrode resistor $r_2$.

It is understood from the equation (a) as follows. Namely, in the case where the number n of the heating resistors $R_i$ driven simultaneously is increased, a so-called voltage drop phenomenon takes place in which the voltage V applied to the heating resistors is reduced unless the sum r of the resistance value of the common resistor $r_1$ and the resistance value of the FPC electrode resistor $r_2$ is minimized. As a result, the driven heating resistors Ri do not generate a desired quantity of heat, thereby resulting in the decrease of printed density.

In this known thermal head, while printing at a fixed density is being performed by using specific ones of the heating resistors Ri, printing at a density identical with that of the specific heating resistors is performed by the remaining heating resistors by gradually increasing the number of the remaining heating resistors subjected to heating. At this time, the solid lines in FIG. 2 show the relation before density correction between actual density of the specific heating resistors (ordinate) and the number of the remaining heating resistors subjected to heating (abscissa). In FIG. 2, assuming that the known sublimation thermal transfer recording apparatus enables recording of 128 graduations of print density, the indication 20", for example, represents the 20th gradation counted from the lightest gradation. In FIG. 2, the left ordinate represents optical density of the specific heating resistors, while the right ordinate represents gradation of the specific heating resistors. It will be seen from FIG. 2 that even if printing at a fixed density is performed by the specific heating resistors, printed density of the specific heating resistors linearly decreases from desired printed density as the number of the remaining heating resistors subjected to heating is increased gradually.

A method of correcting the decrease of printed density due to voltage drop of the heating resistors caused at the time of drive of the thermal head is disclosed in Chapter 4 of a book entitled "Sublimation dye transfer process" (1988). In order to implement the method, the sum r of the resistance value of the common resistor $r_1$ and the resistance value of the FPC electrode resistor $r_2$ is required to be reduced. To this end, a ceramic substrate of the thermal head is made larger in size, thereby resulting in rise of its production cost.

Therefore, so long as the sum r of the resistance value of the common resistor $r_1$ and the resistance value of the FPC electrode resistor $r_2$ is not reduced, decrease of printed density due to the above mentioned voltage drop should occur as the number of the heating resistors driven simultaneously is increased, so that the thermal head is incapable of outputting accurate printed density.

SUMMARY OF THE INVENTION

Accordingly, an essential object of the present invention is to provide, with a view to eliminating the above mentioned disadvantages inherent in the prior art, a method of driving a thermal head, which enables recording of desired density accurately even if the number of the heating resistors subjected to heating is increased.

In order to accomplish this object of the present invention, a method of driving a thermal head enabling recording of multiple gradations and having a plurality of heating resistors is disclosed in which while printing at a fixed density is being performed by specific ones of the heating resistors, printing at the fixed density is performed by the remaining heating resistors by gradually increasing the number of the remaining heating resistors subjected to heating. The method comprises a first step of calculating an amount of density correction, corresponding to an amount of decrease of printed density of the specific ones of the heating resistors due to reduction of quantity of heat generated by the specific ones of the heating resistors, which reduction is caused by simultaneous heating of the specific ones of the heating resistors and the remaining heating resistors. The second step of applying to the specific ones of the heating resistors, a print signal corresponding to the amount of density correction so as to drive the specific ones of the heating resistors such that a desired printed density is obtained; wherein in the first step, the amount of density correction is calculated on the basis of a weight factor, an imaginary number of the heating resistors and a maximum amount of density decreases. The weight factor, assuming that the amount of decrease of printed density of the specific ones of the heating resistors through heating of the specific ones of the heating resistors and a predetermined number of the remaining heating resistors at a fixed density, is identical with an amount of decrease of printed density of the specific ones of the heating resistors through heating of the specific ones of the heating resistors at the fixed density and the remaining heating resistors at a different density not more than the original fixed density, being a ratio of the predetermined number of the remaining heating resistors to the original number of the remaining heating resistors. The imaginary number of the heating resistors is a sum of the weight factors calculated for all the heating resistors with respect to an arbitrary one of the heating resistors. The maximum amount of density decrease is a difference between a maximum printed density and a minimum printed density in the specific ones of the heating resistors at the fixed density.

In the case where printing is performed on the recording medium by heating the specific heating resistors, voltage applied to the specific heating resistors drops in response to increase of the number of the remaining heating resistors subjected to heating for their drive and thus, printed density of the specific heating resistors decreases due to reduction of the quantity of heat generated by the specific heating resistors.

In order to prevent this decrease of printed density of the specific heating resistors caused by the voltage drop, the method of the present invention calculates the amount of density correction, corresponding to the amount of decrease of printed density and applies to the specific heating resistors, the print signal corresponding to the amount of density correction so as to drive the specific heating resistors such that the desired printed density is obtained.

BRIEF DESCRIPTION OF THE DRAWINGS

This object and features of the present invention will become apparent from the following description taken in conjunction with the preferred embodiment thereof with reference to the accompanying drawings, in which.

DETAILED DESCRIPTION OF THE INVENTION

Figure 3:
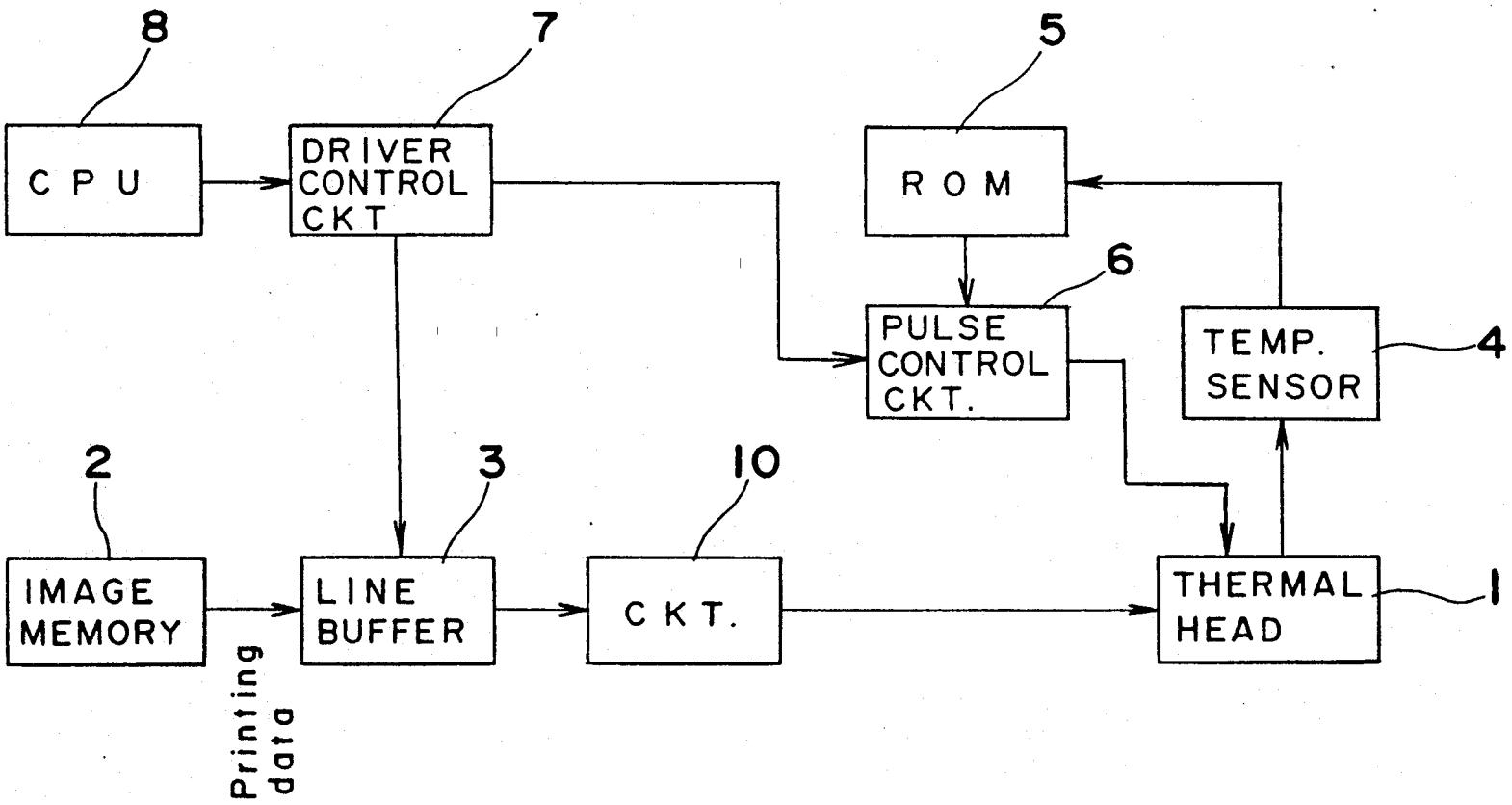
FIG. 3 is a block circuit diagram of a sublimation thermal transfer recording apparatus in which the method of the present invention is performed.

Referring now to the drawings, there is shown in FIG. 3, a sublimation thermal transfer recording apparatus in which a method of driving a thermal head is performed. The sublimation thermal transfer recording apparatus enables recording of multiple gradations, for example, 128 gradations and includes a thermal head 1 having a plurality of heating resistors arranged in a line, an image memory 2 for storing data of one image, a line buffer 3 for storing data of one line and a circuit 10 for calculating decrease of printed density from an imaginary number of the heating resistors, etc. It should be noted that the method of the present invention is mainly concerned with operation of the circuit 10.

The sublimation thermal transfer recording apparatus further includes a temperature sensor 4, a density table ROM 5 for storing a density table showing the relation between gradation and applied pulse width at a predetermined temperature in a state of accumulation of no heat in the heating resistors, a pulse control circuit 6 for generating heating pulse signals (strobe signals) which are determined in accordance with the density table so as to be applied to the heating resistors, a driver control circuit 7 for transmitting control signals to the line buffer 3 and the pulse control circuit 6 and a central processing unit (CPU) 8 for controlling the sublimation thermal transfer recording apparatus as a whole.

Figure 8:
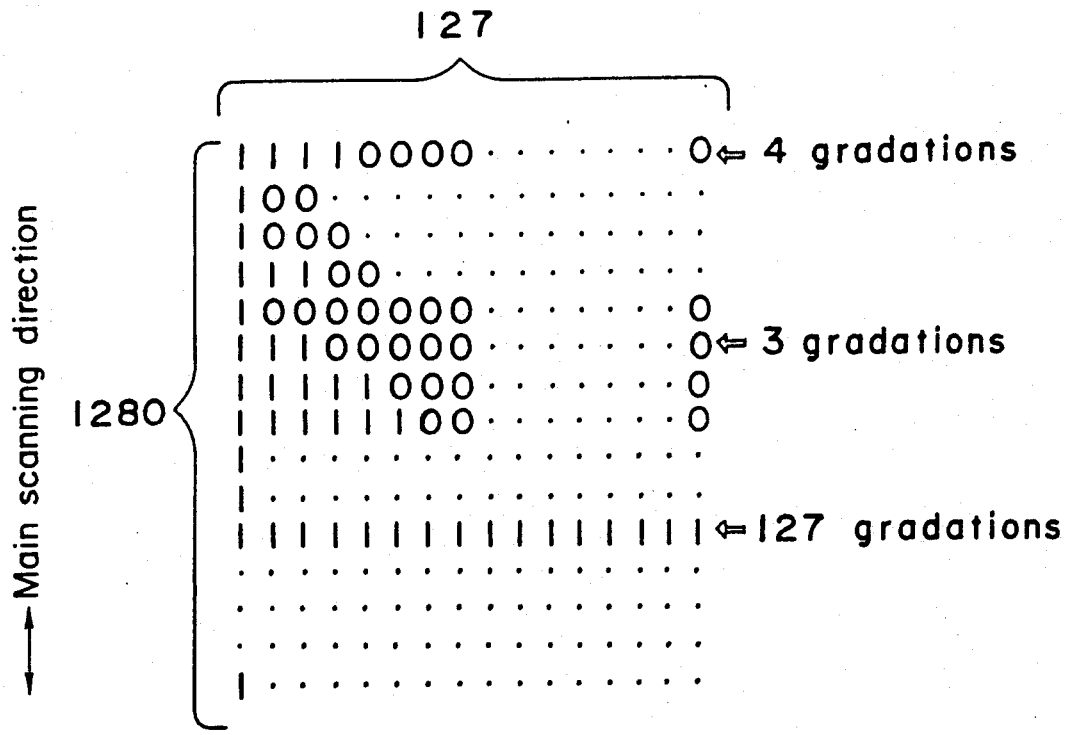
FIG. 8 is a view showing binary data of one line used in the method of the present invention.

Hereinbelow, the method of the present invention, which is mainly based on operation of the circuit 10, is described. As shown in FIG. 8, binary data of one line used in the present invention is formed by a matrix of 1280 rows and 127 columns.

Figure 4:
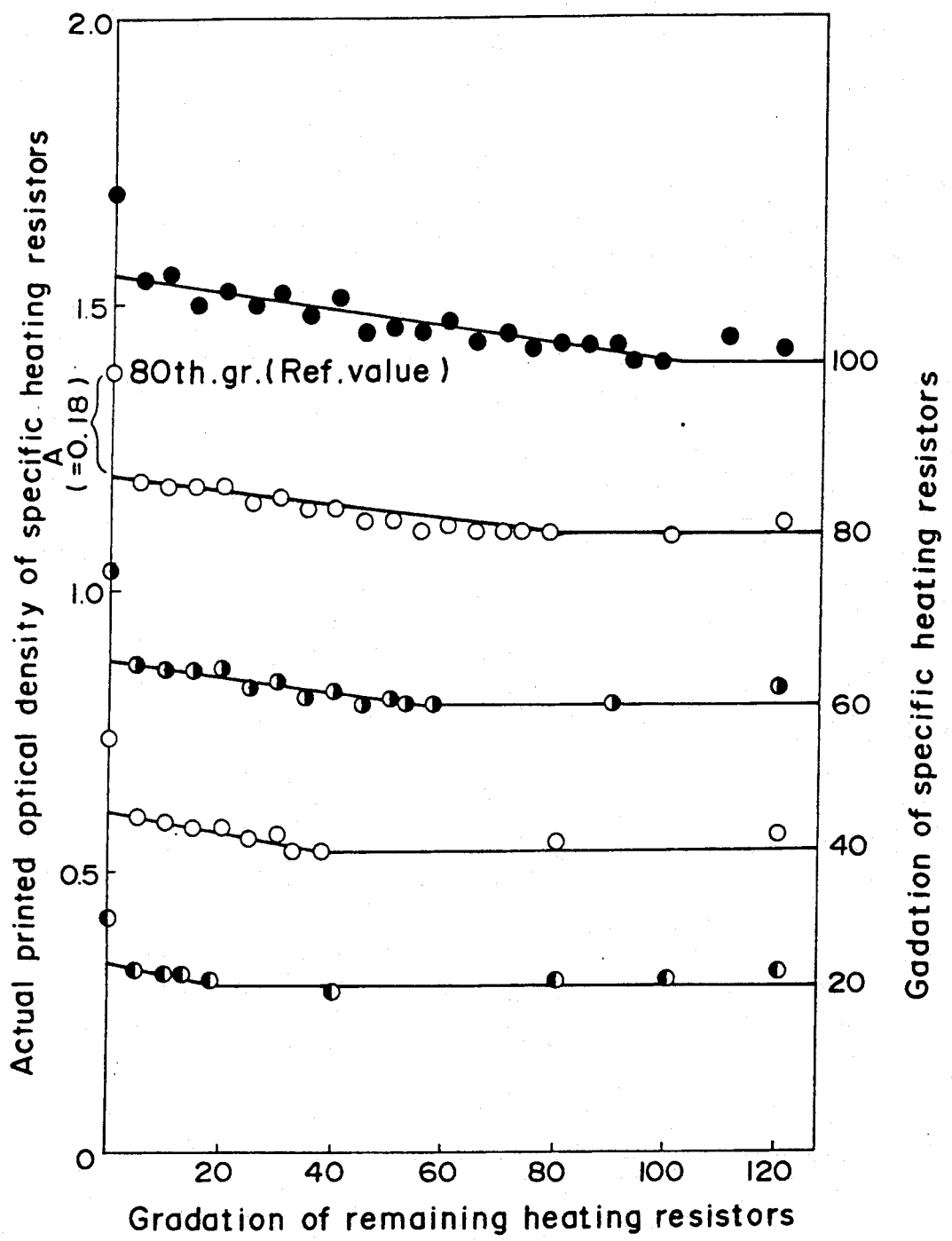
FIG. 4 is a graph showing the relation between actual printed optical density of specific heating resistors and gradation of the remaining heating resistors in printing at a fixed density by the specific heating resistors in the method of prior art.

In the case where while printing at a fixed density is being performed by, for example, 32 specific heating resistors, printing is performed by the remaining 1248 heating resistors by gradually increasing printed density of the remaining heating resistors, FIG. 4 shows relation between actual density of the specific heating resistors (ordinate) and density of the remaining heating resistors (abscissa). In FIG. 4, the left and right ordinates represent optical density and gradation of the specific heating resistors, respectively. FIG. 4 reveals that actual density of the specific heating resistors decreases sharply in the vicinity of an initial density of the remaining heating resistors, then, linearly decreases to such a point as to be identical with density of the remaining heating resistors and thereafter, assumes a substantially fixed value.

Figure 1:
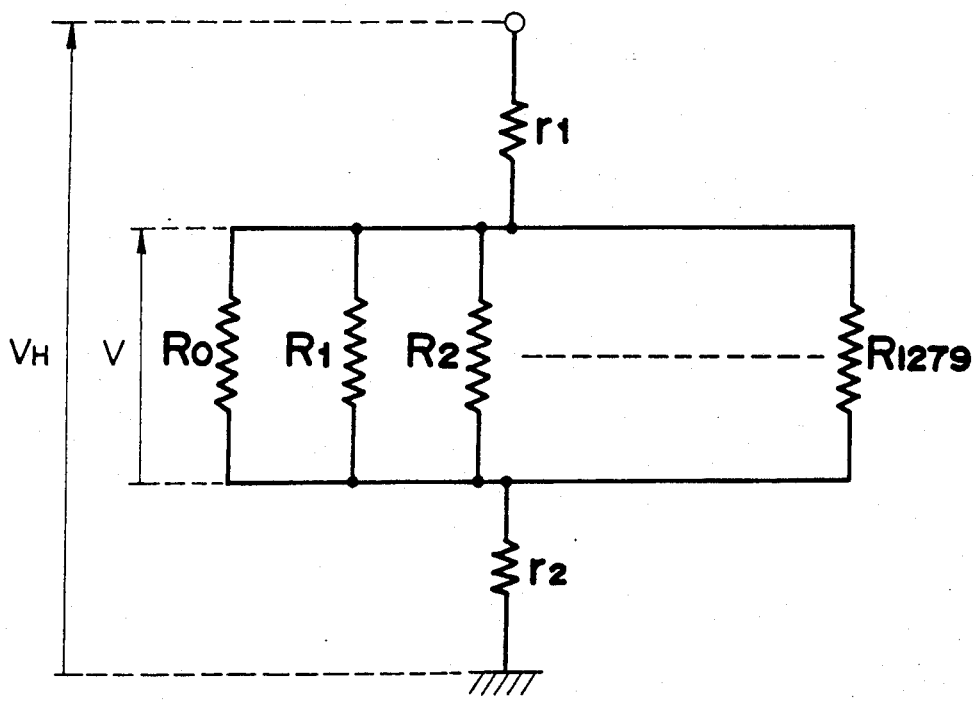
Fig. 1 PRIOR ART
FIG. 1 is a circuit diagram of a conventional thermal head (already referred to)
Figure 2:
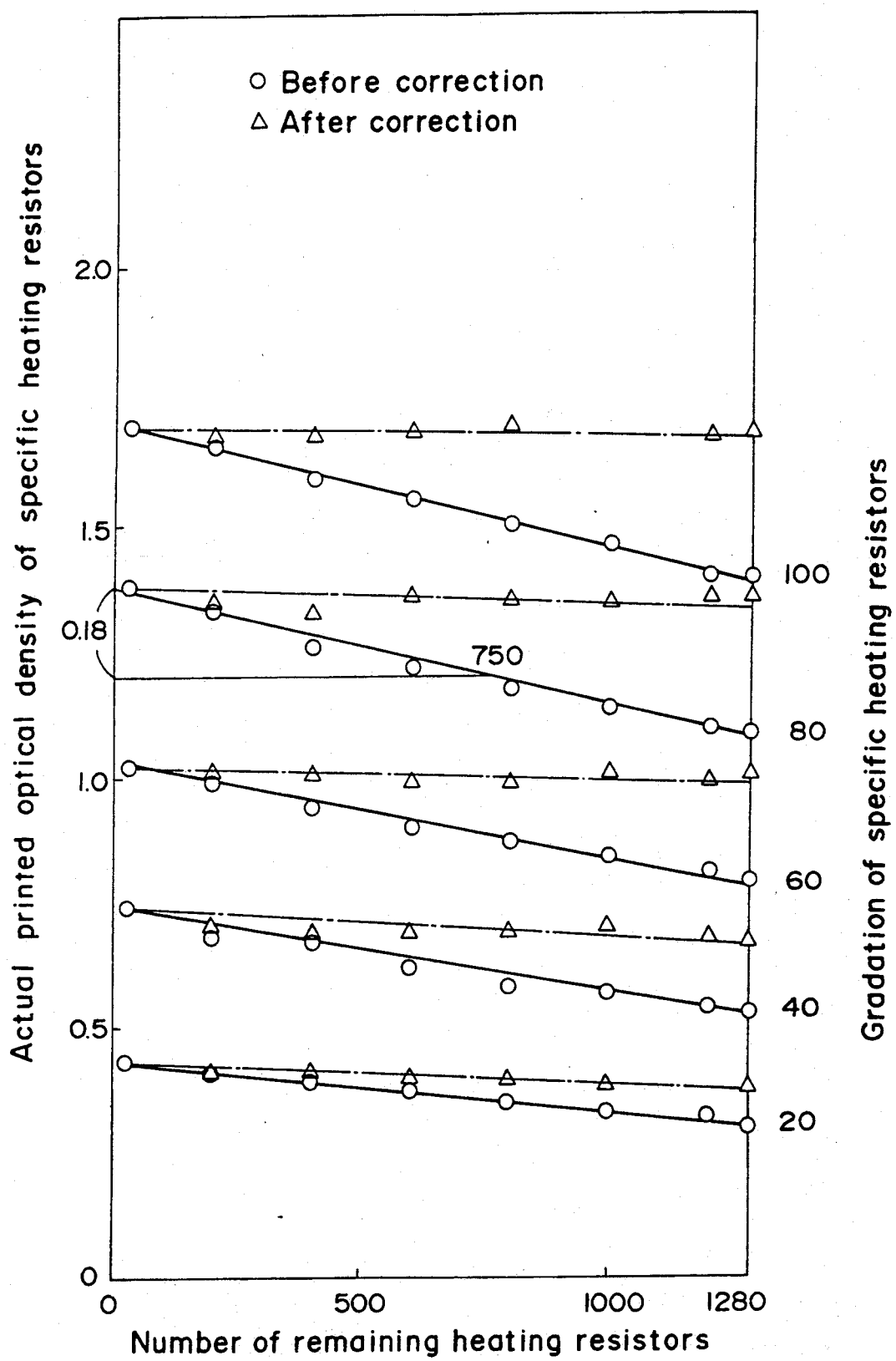
FIG. 2 is a graph showing relation between actual printed optical density of specific heating resistors and the number of the remaining heating resistors in printing at a fixed density by the specific heating resistors in a prior art method and a method of the present invention.

By using FIGS. 2 and 4, weight factor X(n(i)), the amount of density correction in the method of the present invention is based, is obtained. In FIG. 4, assuming that the sublimation thermal transfer recording apparatus enables recording of 128 gradations, the indication "20", for example, represents the 20th gradation counted from the lightest gradation. For example, when printed density of the specific heating resistors is set to the 80th gradation and printed density of the remaining heating resistor is set to the 1st gradation, actual density of the specific heating resistors descends sharply through an optical density of about 0.18 as shown by a portion A in FIG. 4. This descent of optical density of 0.18 in FIG. 4 corresponds to heating of 750 heating resistors in the case of printing at the density of the 80th gradation in FIG. 2. Thus, an imaginary number of the heating resistors subjected to heating in FIG. 4 becomes identical with that of FIG. 2. Hence, the following equation (1) is established:

$$1248 \times X(80) = 750 \times X(0) \quad (1)$$

where X(n(i)) denotes weight factor at the time when difference in density between the specific heating resistors and the remaining heating resistors is n(i) and X(0)=1.0 is set.

Figure 5:
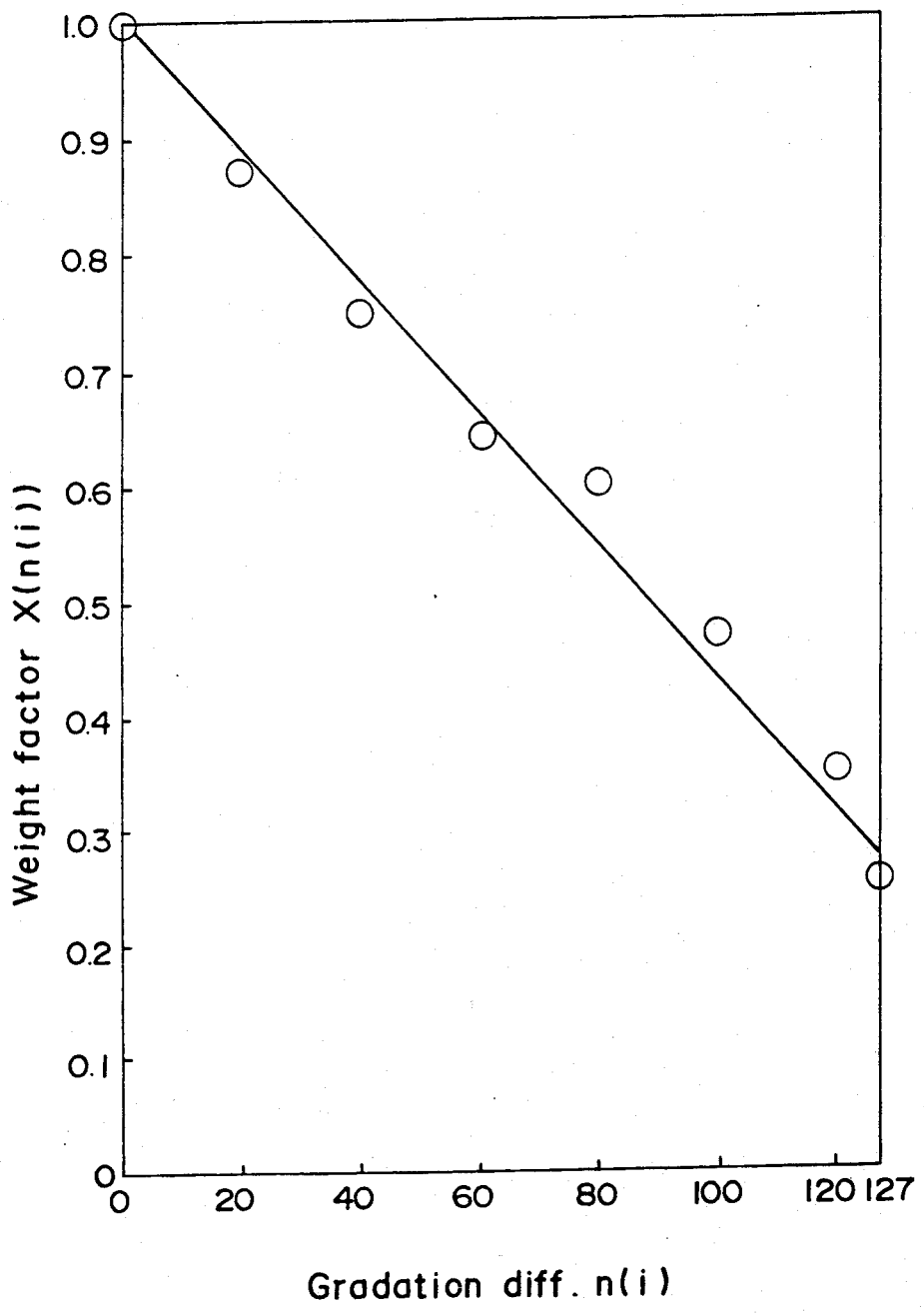
FIG. 5 is a graph showing the relation between a weight factor and difference in gradation between the specific heating resistors and the remaining heating resistors in the method of the present invention.
Figure 7:
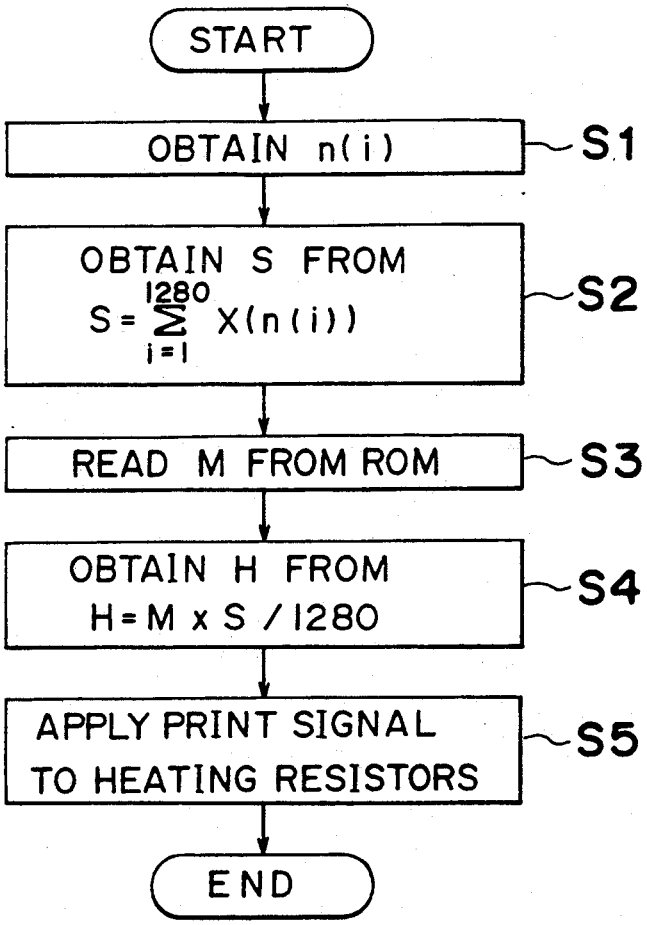
FIG. 7 is a flow chart showing sequence of the method of the present invention.

As shown in FIG. 7, the difference n(i) in density between the specific heating resistors and the remaining resistors is initially obtained at step S1 in the method of the present invention. By solving the equation (1), X(80)=0.601 is obtained. When the weight factor X(n(i)) is obtained for each density of the specific heating resistors, FIG. 5 shows relation between the weight factor X(n(i)) and the difference n(i). FIG. 5 illustrates that the weight factor X(n(i)) linearly decreases in response to increase of the difference n(i).

In the foregoing, the number of the specific heating resistors is set to 32, while the number of the remaining heating resistors is set to 1248. However, since density correction is performed for each of the heating resistors, calculation of density correction is performed for each of the heating resistors, hereinbelow. By obtaining the weight factors X(n(i)) corresponding to the differences n(i) for all the heating resistors and taking a sum of the weight factors X(n(i)), an imaginary number S of the heating resistors is obtained.

Therefore, assuming that the difference n(i) on the abscissa of FIG. 5 represents difference in density between a specific heating resistor (an arbitrary one of the 1280 heating resistors) and the remaining heating resistors, the imaginary number S of the heating resistors is given by the following equation (2).

$$S = \sum_{i=1}^{1280} (1 - 0.00551 \times n(i)) = \sum_{i=1}^{1280} X(n(i)) \quad (2)$$

In the above equation (2), X(n(i)) denotes the linear function of FIG. 5. Thus, at step S2 in FIG. 7, the imaginary number S of the heating resistors is calculated from the equation (2) by obtaining the weight factor X(n(i)) from FIG. 5.

Figure 6:
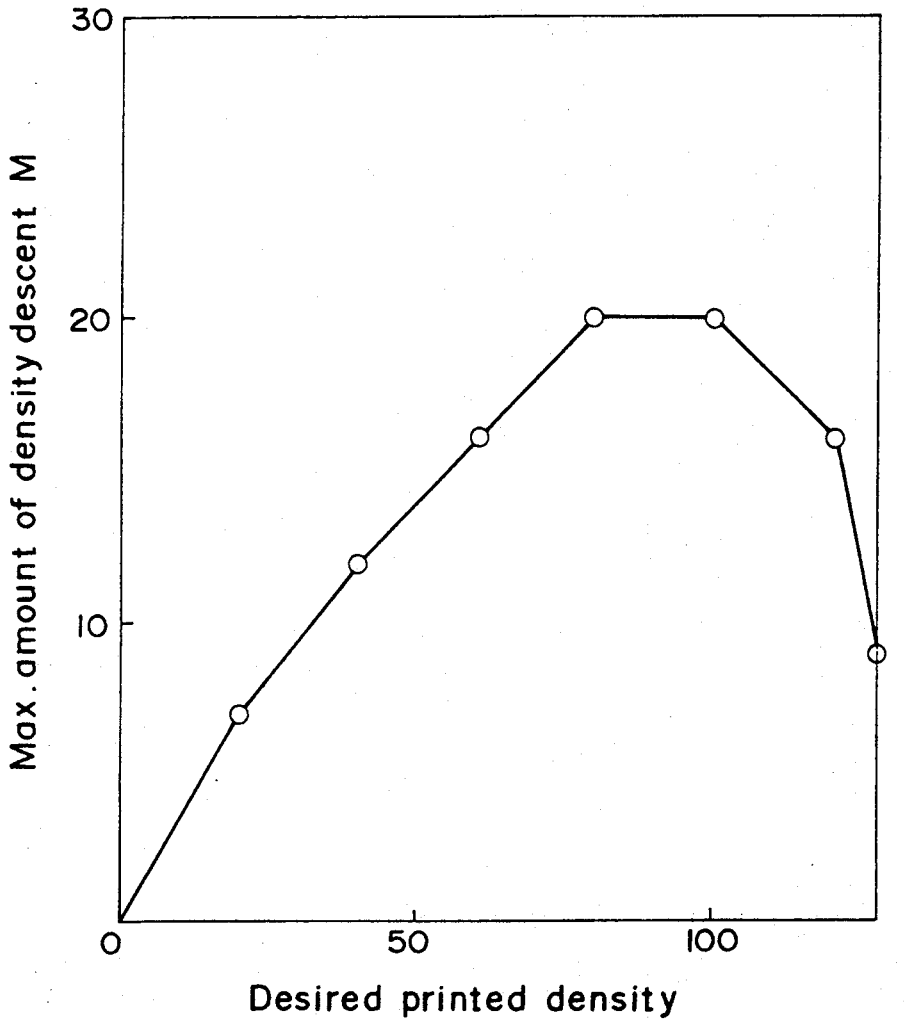
FIG. 6 is a graph showing the relation between maximum amount of density decrease of the specific heating resistors in solid lines of FIG. 2 and desired printed density in the method of the present invention.

FIG. 6 shows, at the time of printing at a fixed density by the specific heating resistors as shown by the solid lines in FIG. 2, the relation between maximum amount of density decrease i.e. difference between maximum and minimum printed densities of the specific heating resistors and desired printed density. FIG. 6 reveals that the maximum amount of density decrease is increased as the desired printed density is increased gradually and reaches its peak when the desired printed density ranges from the 80th gradation to the 100th gradation. After the peak, the maximum amount of density descent decreases.

Namely, assuming, that character M denotes the maximum amount of density decrease, the maximum amount M of density decrease for an inputted density (inputted gradation) is read from a ROM in the circuit of the sublimation thermal transfer recording apparatus at step S3 in FIG. 7. Then, at step S4 in FIG. 7, amount H of density correction for each specific heating resistor is obtained from the following equation (3).

$$H = M \times S/1280 \quad (3)$$

Finally, at step S5 in FIG. 7, the amount H of density correction is added to the inputted density (inputted gradation) so as to obtain a corrected print signal and the corrected print signal is applied to the specific heating resistors.

One-dot chain lines in FIG. 2 show the relation between actual printed density of the specific heating resistors and the number of the remaining heating resistors at the time of printing at a fixed density by the specific heating resistors after printed density for each specific heating resistor has been corrected. By comparing the solid lines with the one-dot chain lines in FIG. 2, printed density of the specific heating resistors before density correction, namely the solid lines linearly decrease as the number of the remaining heating resistors is increased, so that desired printed density cannot be obtained. On the other hand, printed density of the specific heating resistors after density correction, namely the one-dot chain lines run substantially horizontally without any noticeable decrease and thus, desired printed density can be obtained.

In the method of the present invention, printed density of the specific heating resistors is corrected on the basis of the imaginary number of the heating resistors representing a sum of the weight factors of the respective remaining heating resistors, etc. in order to prevent decrease of printed density due to voltage drop of the specific heating resistors caused by heating of the remaining heating resistors, whereby desired printed density can be obtained.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A method of driving a thermal head having a plurality of heating resistors enabling recording of multiple gradations of printed density by the plurality of heating resistors, comprising the steps of:

calculating an amount of printed density correction (H) corresponding to an amount of decrease of printed density to be produced by specific ones of the plurality of heating resistors due to reduction of the quantity of heat generated by said specific ones of the heating resistors caused by simultaneous heating of said specific ones of the heating resistors and the remaining heating resistors of the plurality of resistors, the amount of printed density correction being calculated on the basis of a weight factor, an imaginary number(S) of the heating resistors and a maximum amount of printed density decrease wherein;

the weight factor is computed assuming that the amount of decrease of printed density of said specific ones of the plurality of heating resistors through their heating and a predetermined number of the remaining heating resistors at a fixed printed density being identical with an amount of decrease of printed density of said specific ones of the plurality of heating resistors through their heating at the fixed printed density and the predetermined number of remaining heating resistors at a different printed density not greater than the fixed printed density, being a ratio of said predetermined number of the remaining heating resistors to the original number of the remaining heating resistors;

the imaginary number of the heating resistors being a sum of the weight factors calculated for all the heating resistors with respect to any given one of the plurality of heating resistors;

the maximum amount of printed density decrease (M) being a difference between a maximum printed density and a minimum printed density in said specific ones of the heating resistors at the fixed printed density; and forming and applying to said specific ones of the heating resistors a print signal for printed density correction which is corrected on the basis of said amount of printed density correction so as to drive said specific noes of the heating resistors to obtain a desired printed density.

2. A method as claimed in claim 1, wherein the amount (H) of printed density correction is calculated on the basis of the weight factor (X(n(i))), the imaginary number (S) of the heating resistors and the maximum amount (M) of density decrease by the following equations:

$$H = M \times S/N$$

$$S = \sum_{i=1}^{N} X(n(i))$$

where N denotes the number of the plurality of the heating resistors.

3. A method of driving a thermal head having a plurality of heating resistors enabling recording of multiple gradations of printed density by the plurality of heating resistors, comprising the steps of:

obtaining difference (n(i)) in printed density between specific ones of the plurality of heating resistors and the remaining heating resistors of the plurality of heating resistors so as to obtain an imaginary number (S) of the heating resistors by the following equation:

$$S = \sum_{i=1}^{N} X(n(i))$$

where N denotes the number of the plurality of the heating resistors and X(n(i)) denotes a weight factor;

reading a maximum amount (M) of printed density decrease from a read-only memory so as to obtain an amount (H) of printed density correction by the following equation:

$H = M \times S/N$; and forming a print signal corrected by the amount (H) of printed density correction so as to apply the print signal to said specific ones of the heating resistors.

* * * * *